US005765612A

United States Patent [19]

Morin

[11] Patent Number: 5,765,612

[45] Date of Patent: Jun. 16, 1998

[54] QUICK-CONNECT ENGINE OIL DRAINAGE SYSTEM

[76] Inventor: Claude Morin, RFD 2, Box 1665, Bangor, Me. 04401

[21] Appl. No.: 701,074

[22] Filed: Aug. 21, 1996

[51] Int. Cl.[6] ..... B65B 1/04; B65B 3/00; B67C 3/00

[52] U.S. Cl. ..... 141/383; 141/384; 141/346; 137/614.05; 137/614.2; 251/149.6; 184/1.5

[58] Field of Search ..... 141/383, 384, 141/98, 346; 251/149.6; 137/351, 614.05, 614.2, 614.04; 184/1.5, 106; 285/361, 402

[56] References Cited

U.S. PATENT DOCUMENTS

| | | | |
|---|---|---|---|
| 1,846,877 | 2/1932 | Knapp | 184/1.5 |
| 1,885,321 | 5/1932 | Benn | 285/361 |
| 2,230,098 | 1/1941 | Wurzburger | 285/361 |
| 3,704,002 | 11/1972 | Sharzynski | 251/149.6 |
| 3,720,287 | 3/1973 | Martel . | |
| 3,743,053 | 7/1973 | Kuklewicz . | |
| 4,078,763 | 3/1978 | Yamamoto . | |
| 4,086,981 | 5/1978 | Mitsui | 137/351 |
| 4,709,722 | 12/1987 | Knapp | 184/1.5 |
| 4,815,566 | 3/1989 | Caruso et al. . | |
| 4,905,964 | 3/1990 | Shiozaki | 251/149.6 |
| 5,048,578 | 9/1991 | Dorf et al. . | |
| 5,074,380 | 12/1991 | Bedi et al. . | |
| 5,209,198 | 5/1993 | Bedi . | |
| 5,259,588 | 11/1993 | Crosby, Jr. et al. . | |
| 5,476,154 | 12/1995 | Sage | 184/1.5 |
| 5,630,451 | 5/1997 | Bernard | 141/313 |

*Primary Examiner*—David J. Walczak
*Assistant Examiner*—Timothy L. Maust
*Attorney, Agent, or Firm*—Chris A. Caseiro; Thomas L. Bohan

[57] ABSTRACT

A quick-connect hookup that includes a connector and an adapter designed for quick and easy assembly and disassembly from a common oil drain valve. The adapter is formed with a standardized tabbed section and a customized threaded section. The threaded section of the adapter is made to fit within an outlet of the oil drain valve in substantially permanent manner. The tabbed section of the adapter includes tabs that are made to quickly attach to and detach from the connector via recesses in the connector. The invention includes a method of connecting and evacuating waste oil through the use of vacuum forces and the quick-connect hookup.

6 Claims, 3 Drawing Sheets

QUICK-CONNECT ENGINE OIL DRAINAGE SYSTEM

BACKGROUND OF THE INVENTION

1. Field of Invention

The invention relates to maintenance of motor engines that require periodic replacement of engine oil. More particularly, the invention relates to a method of and a device for providing an efficient means of coupling between various engine oil drainage systems and a drain valve installed in the engine crank case or engine oil reservoir of a motor vehicle.

2. Description of Prior Art

In the maintenance of automobile, truck, and airplane engines that are internally lubricated with viscous motor oil, periodic replacement of worn and dirty lubricating oil is necessary. This is so because the moving engine parts break down the oil with frictional heat and foul it with metal particles, dirt, grit, and other contaminants that get into areas bathed in the lubricating oil. To effect this replacement, maintenance persons must first drain the used oil from the engine, and in particular from the crank case or oil reservoir. Traditionally, used motor oil has been drained by removing a plug from the bottom of the crank case or oil reservoir and allowing the oil to drain under gravity into a container or into a grease pit.

Recent social and economic developments have generated pressure to change the way in which drainage of such oil is effected. Laws and regulations protective of the environment and relating to transportation, storage, and disposal of used motor oil have constrained maintenance personnel to take particular care in the drainage of motor oil so as to avoid spillage. At the same time, increases in maintenance costs have made it imperative to find faster and more efficient means for removing and replacing motor oil.

Thus, various new methods for removing spent motor oil without spillage have been introduced, methods that involve sealing drainage systems so as to provide direct coupling between the engine crank case or oil reservoir and the storage or disposal container. Rather than depending on the oil spilling freely into an open container or reservoir by gravity, these systems cause the oil to flow, or to be drawn, through a tube or hose into a closed container. These systems still generally require the removal of the drain plug from the engine crank case or oil reservoir in order to connect the inflow end of the hose or tube into the drain. Alternatively, these systems may require that the engine's drain plug be replaced by a particular drain valve designed to couple directly with a particular draining system. One prior-art system has been disclosed by Kulkewicz (U.S. Pat. No. 3,743,053); it uses a motorized evacuation pump, hoses for intake and output attached, respectively, to the intake and output fittings of the motorized pump, and an adaptive coupling for connection of the intake hose to the engine oil reservoir. The adaptive coupling of Kulkewicz is permanently mounted into the drain opening of the engine oil reservoir, replacing the standard drain plug. It incorporates an internal spring-closed valve and a fitting into which the intake hose of the motorized pump is threaded to form a leak-tight seal and connection to the engine oil reservoir through the spring-closed valve. The motorized pump reduces the pressure in the intake hose on the adaptive coupling, thus opening the spring-closed valve so that oil can be drawn through the motorized pump to the output hose, which can then be directed into a ready disposal container.

Another prior-art system, described by Martel (U.S. Pat. No. 3,720,287), employs a similar pump and hose arrangement similarly attached to the engine oil reservoir by means of an adaptive coupling including, in this instance, a mechanical valve operated by turning a handle. The Martel apparatus further adds a container directly connected to the output hose so as to receive the drained oil, a container for holding crank case flushing fluid, and containers to hold new replacement oil. The Martel apparatus, in addition to forcibly draining used oil, incorporates the further functions of forcibly flushing residual oil from the engine, and then forcibly pumping new oil into the engine.

Other self-contained, specific systems and devices for exchanging motor oil exist, including that of Bedi (U.S. Pat. No. 5,209,198). Bedi includes the functions of flushing and cleaning the residual used oil from the engine in the manner of Martel. The nature of such full-function oil-evacuation-and-exchange systems requires the replacement at considerable expense of the readily-available maintenance tools and equipment otherwise used for draining oil and other maintenance functions. Consequently, use of these drainage and exchange systems has not become widespread in the industry. Furthermore, the manner by which such systems are coupled to the engines are limited by the particular vehicle design—specifically, with the reduced flexibility that this implies.

Concurrently with the development of the prior-art systems described above, simple replacements for the standard, solid drain plug have also been developed. Typically, such replacement drain plugs incorporate a valve that may be quickly and easily opened, making unnecessary the removal of the plug. A further advantage afforded by the incorporation of such drain valves into drain plugs is that the maintenance person is thus better able to control the drainage flow, and thereby to reduce the mess and spillage associated with the traditional methods of oil-drainage. In certain instances, replacement drain plugs incorporating valves along with drain spouts permit the drainage flow to be directed into a tube or hose, which may in turn be connected to a common fluid evacuation system. Such a replacement drain plug was discussed by Caruso et al. (U.S. Pat. No. 4,815,566).

The Caruso et al. drain plug incorporates a mechanical valve actuated by means of an Allen wrench or screwdriver and further incorporates a discharge spout to which a hose leading to a disposal reservoir is attached, before draining, also described by Caruso et al. Another replacement drain plug incorporating a valve has been disclosed by Crosby et al. (U.S. Pat. No. 5,259,588), wherein valve actuation is accomplished by manually turning and pulling a pin. Crosby et al. does not disclose a system including a specific discharge reservoir, but its drain plug/valve does incorporate a discharge spout to which a hose may be attached. Such a hose may be used to simply direct the flow, without spillage, into disposal containers or holding tanks. Additionally, such a hose may connect to the intake filling of a pump for forced evacuation of the oil. Both the Caruso et al. replacement plug and the Crosby et al. replacement plug have the advantage of being able to be installed and operated by readily available maintenance tools.

A related device was described by Dorf et al. (U.S. Pat. No. 5,048,578). Dorf et al. describes a coupling apparatus comprising two parts. One part is a replacement drain plug having a spring-actuated discharge valve. The second part of the coupling is a coupler made to be inserted into the valve opening of the drain plug part and to be secured in the drain plug by means of notches and tabs engaged by twisting the coupler within the plug valve opening. The coupler incorporates a forward-projecting pin which, upon the coupler being inserted and secured within the drain plug valve, actuates the valve. The coupler is made to be attached, by means of a compressible collar, to the end of a hose or tube.

The general idea of an engine-oil-reservoir-drain-plug device incorporating a drain valve has become widely accepted by the engine maintenance industry and particularly with respect to truck engines made by major truck manufacturers. In particular, such a valve manufactured by Fumoto Engineering of America and modified somewhat for use in engines of several manufacturers, has gained widespread use on large truck engines. The Fumoto-manufactured drain valve, disclosed by Yamamoto (U.S. Pat. No. 4,078,753), is a device that is connected directly to the engine crank case drain in place of the standard drain plug, having overall dimensions similar to the standard drain plug, and incorporating a simple, mechanical valve actuated by turning an external handle or key. This Yamamoto drain valve allows oil to drain by gravity through a hole bored directly through the device and through the valve mechanism when the valve and bore are properly aligned. The Yamamoto device does not provide an outlet spout, nor any other means of connecting an external system to the engine oil reservoir drain.

The prior art fails to provide any means of connection to the widely used Fumoto-manufactured engine-oil-drain valve ("Fumoto-valve") that would eliminate all oil spillage, including prevention of the emission of hydrocarbon vapors to the atmosphere. Such environmental concerns prevalent in the gasoline industry are equally important to oil-changing facilities and will become more so as regulation of hydrocarbon emissions extends to such facilities. Therefore, what is needed is an oil-changing system that provides the environmentally protective features of closed, directed-flow drainage systems to be used with the Fumoto-valve (and valves like it) and a variety of passive oil collection systems. What is also needed is such a device that provides a positive connection between such drain valves and a variety of active engine-oil-evacuation systems, thereby providing access to the increased efficiency and speed of such pump-operated systems. Further, it is desired that such devices provide a quick and secure means of connecting evacuation systems to the Fumoto and similar oil-drain-valves.

SUMMARY OF THE INVENTION

It is an object of the present invention to combine the advantages of speed and ease-of-opening provided by the widely used Fumoto-valve with the environmentally protective features of closed, directed-flow drainage systems by providing a means of connecting the Fumoto-manufactured oil drain valve and similar valves to a variety of passive oil collection systems.

Another object of the present invention is to provide a positive connection between the Fumoto and similar oil-drain-valves and a variety of active engine oil evacuation systems, thereby providing access to the increased efficiency and speed of such pump-operated systems.

A still further object of the present invention is to contribute to the general desire for more efficient and cost-effective engine maintenance by providing a means of quickly connecting and securing the present invention to the Fumoto oil drain valve and similar oil drain valves.

The present invention overcomes the lack of connectivity of the Fumoto-valve, and overcomes the disadvantages of scale, cost, and proprietary nature of integrated oil evacuation systems, by providing efficient connector means for linking the Fumoto-valve (and similar valves) to a hose which, in turn, may be connected to a variety of economically obtained or adapted oil drainage and oil evacuation systems. The present invention relates to a connector incorporating a valved passage through which oil may freely flow. This discussion focuses on the present invention in combination with a Fumoto-valve; however, any similar valve may be used. The connector is attached to a Fumoto-valve that has been fitted with an adapter as part of the present invention. It should be noted that adapters of various shapes and sizes may be utilized without straying from the intended scope of the invention. The novel design aspect is the adapter's ability to secure the connector of the present invention to a variety of known oil drain valves.

The present invention is a connector and adapter for use with a Fumoto-type oil drain valve and involves sliding the connector's laterally-slotted receiving end over a flange of the adapter at the outlet end of the drain valve. A raised inlet opening of the connector engages the adapter at the outlet opening of the drain valve and forms a positive connection. The outlet end of the connector incorporates an offset fitting to which a drainage hose or an evacuation hose may be attached. A variety of types of connections may be utilized between the hose and the outlet end of the,connector such as, but not limited to, interference fittings, screw-type fittings, and snap-on fittings. Further securing of the connection of the hose at the outlet end of the connector may be enhanced by means of a readily available hose clamp of the appropriate size. Coupling of the connector to the valve requires no tools, but is preferably secured by means of the slot and flange.

Connection is accomplished with a single, quick motion that involves a manual smooth-sliding, twisting motion of the connector by a maintenance person. The connection is made leak-resistant by the raised inlet opening of the connector fitting inside the adapter at the outlet opening of the drain valve with an O-ring therebetween. The O-ring may be made of rubber or any suitable material that provides adequate flexibility and sealing characteristics. As well, prior to connection, the O-ring is preferably located around the raised inlet opening of the connector.

Another feature of the present invention is a valve within the connector that allows a user to control flow of oil through the connector. While a sliding, cylindrical valve is shown in accordance with the preferred embodiments of the present invention, it should be noted that any type of valve may be used. The critical aspect of this valve is that an oil evacuation system attached to the connector of the present invention is maintained as a closed system. Accordingly, the sliding valve may be closed before and after attachment to the adapter on the oil drain valve in order to maintain a sealed evacuation system.

The present invention presents numerous advantages over the prior art. It is quick and easy to use. It eliminates oil spills and is thus environmentally friendly. It can be made portable. The uses for such an invention are wide-reaching. The present invention can be used in numerous applications such as: 1) fleets of trucks, cars, and planes; 2) logging and construction equipment; 3) paper mills; 4) chemical plants; and 5) countless numbers of factories with large mechanized equipment requiring lubricating oil.

It is to be understood that other objects and advantages of the present invention will be made apparent by the following description of the drawings according to the present invention. While a preferred embodiment is disclosed, this is not intended to be limiting. Rather, the general principles set forth herein are considered to be merely illustrative of the scope of the present invention and it is to be further understood that numerous changes may be made without straying from the scope of the present invention.

DETAILED DESCRIPTION OF THE PREFERRED EMBODIMENTS

Figure 1:
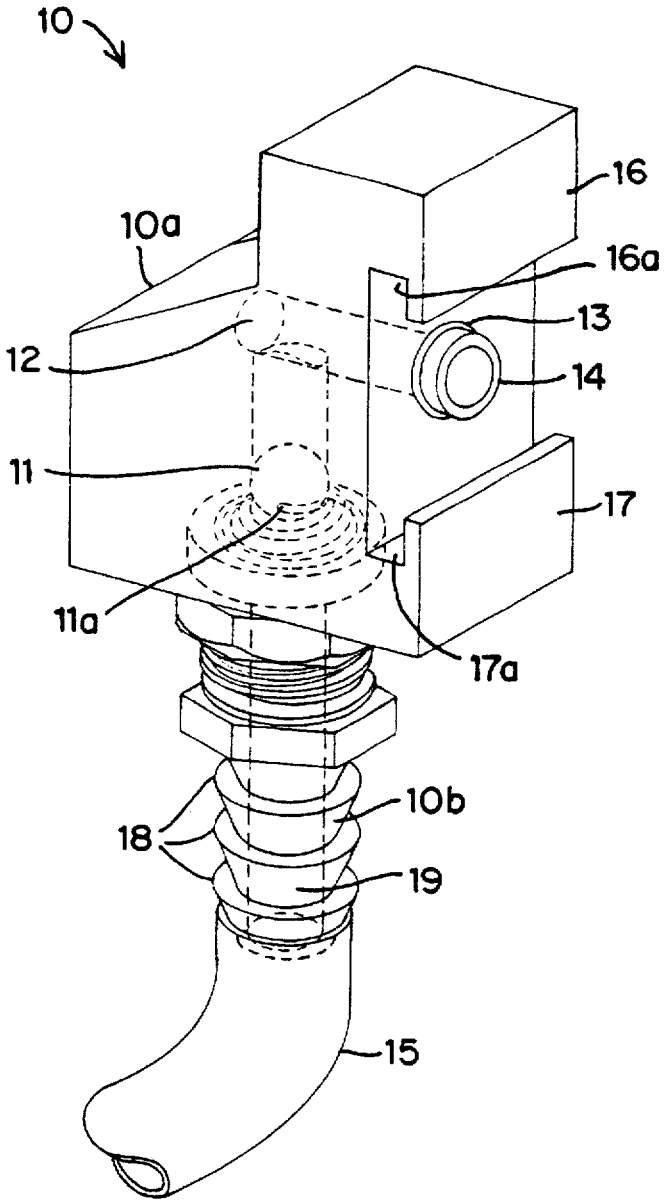
FIG. 1 is a perspective view of a connector in accordance with a first preferred embodiment of the present invention and shows a ball-and-spring valve and with a portion of a hose.

In FIG. 1, a connector 10 is shown according to a first preferred embodiment of the present invention. Connector 10 includes a connector head 10*a* and a connector base 10*b*. Connector head 10*a* includes a ball-and-spring valve 11 that is held within an upper oil passageway 12 by spring 11*a*. Upper oil passageway 12 and a lower oil passageway 19 (both shown by hidden lines) are located within connector 10 between inlet 14 and a hose 15. An upper flange 16 and a lower flange 17 are arranged opposing one another on connector 10.

The connector 10 is preferably machined from a durable, non-corrosive metal; however, any suitable method of manufacture (e.g., injection molding, drop-forging, lost-wax method) may be used to manufacture the connector. As well, any suitable material (e.g., high-impact plastic, stainless steel, chrome) may be utilized that will provide the necessary durable, non-corrosive qualities. The upper flange 16 and lower flange 17 provide elongated recesses 16*a* and 17*a*, respectively, therebeneath. Between the flanges 16 and 17 is located a raised connector inlet 14. Inlet 14 is surrounded at its base by an O-ring 13.

Valve 11 is normally closed so as to block oil flow through the connector 10. Spring 11*a* provides an expansion force that presses against the top of connector base 10*b* and ball valve 11. Providing suction in hose 15 moves ball valve 11 to an open position, thus compressing spring 11*a*. When suction stops, the spring 11*a* automatically forces ball valve 11 into its closed position. This allows a user to selectively open and close oil passageways 12 and 19. This automatic closing feature of valve 11 is particularly useful in order to prevent any leakage from hose 15 when the connector 10 is not in use. Valve 11 may also be arranged as a multiport valve in order to divert oil to additional hoses (not shown).

Figure 2:
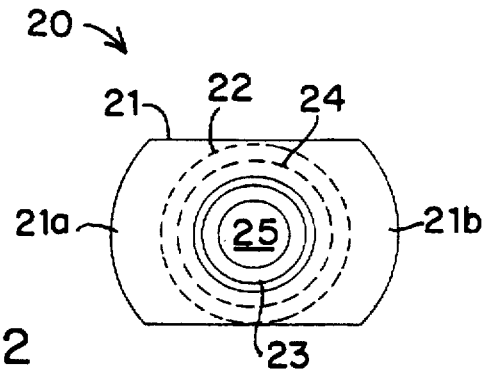
FIGS. 2 and 3 are top and perspective views, respectively, of the first referred embodiment of an adapter used together with the connector as shown in FIG. 1 according to the present invention.
Figure 3:
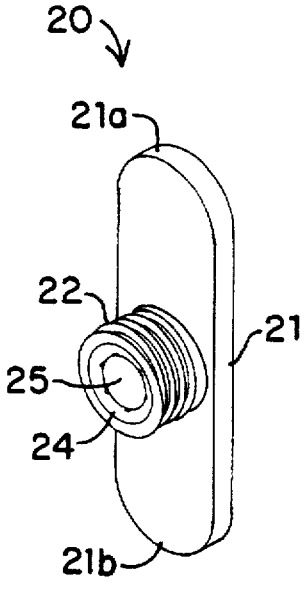

FIGS. 2 and 3 show an adapter 20 according to the first preferred embodiment of the present invention. Adapter 20 has flat section 21 and threaded section 22 with an aperture 25 centrally located within both sections 21 and 22. Within an inner diameter of threaded section 22, there is a ring 24. This ring 24 is preferably made of a molded plastic but may be of any other suitable material that would allow smooth movement and sealing arrangement of a standard ball valve in a standard oil drain valve. One such standard ball valve 31 is shown by hidden lines in a standard oil drain valve 30 in FIG. 5. Continuing with FIG. 2 it can be seen that the adapter 20 also has an annular recess 23 on the side of the flat section 21, which flat section 21 includes tabs 21*a* and 21*b* formed on opposite sides of adapter 20.

Figure 4:
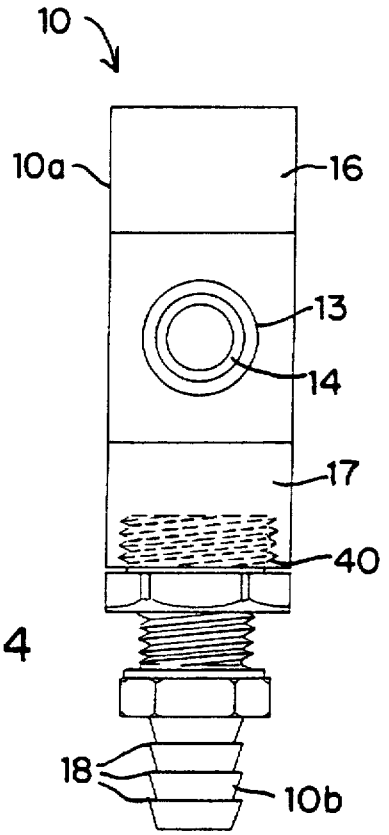
FIG. 4 is a connection-side view of the connector as shown in FIG. 1 with the threaded attachment between the connector head and the connector base is shown by hidden lines.

Connector 10 is again shown in FIG. 4. While connector 10 in FIG. 4 is identical to the connector 10 in FIG. 1, the valve 11 is not shown and the hose 15 is omitted from FIG. 4 so as to clearly illustrate the connection side view. Further, a threaded attachment means 40 between the connector head 10*a* and the connector base 10*b* is shown by hidden lines.

Accordingly, connector base 10*b* is manufactured as a separate piece from connector head 10*a*. The valve 11 and spring 11*a* are therefore able to be placed into connector head 10*a* before the connector base 10*b* is screwed into place.

Figure 5:
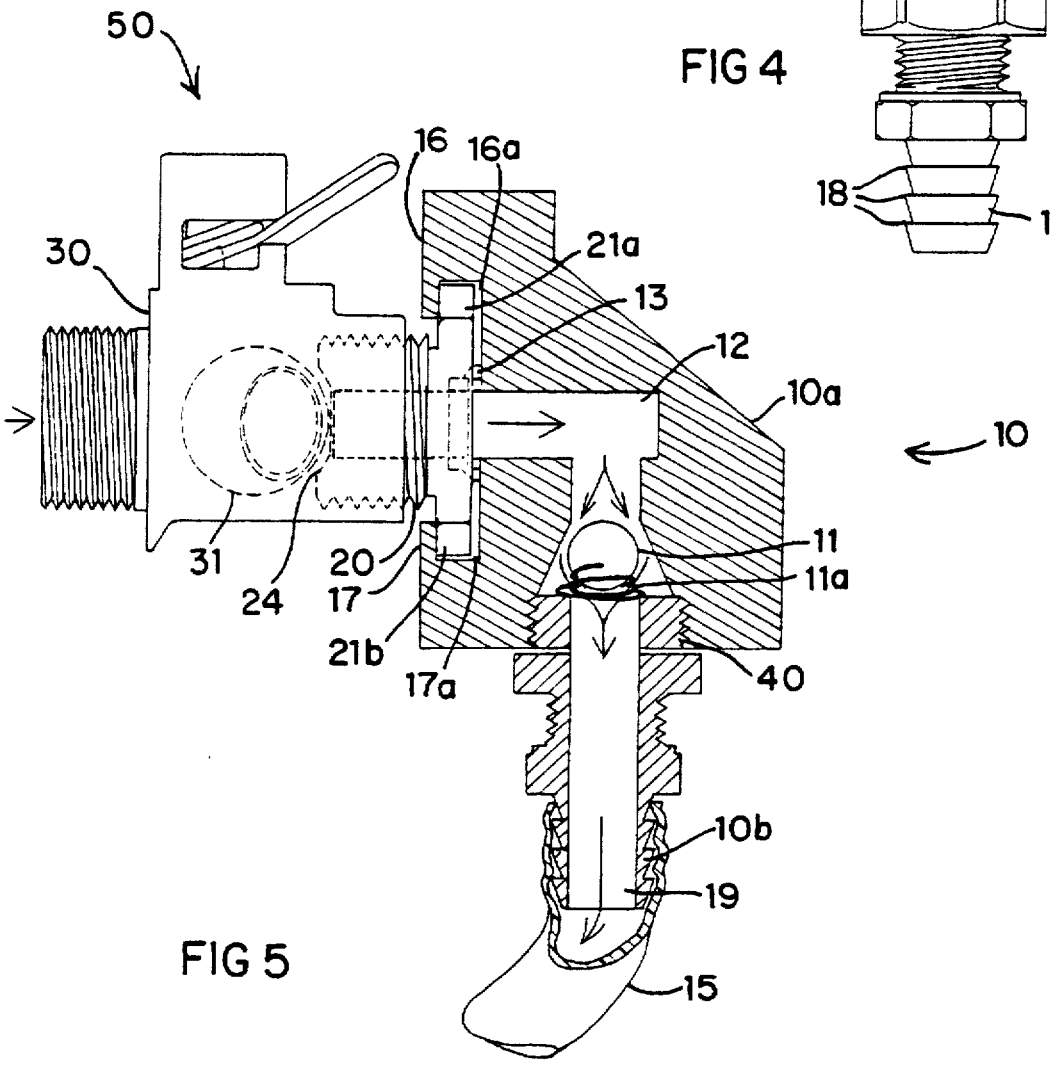
FIG. 5 is a partially cut-away side view of the adapter shown in FIGS. 2 and 3 in use together with the connector as shown in FIG. 1 and common oil drain valve with oil-flow indicated by arrows.

FIG. 5 shows a quick-connect hookup 50 that includes both connector 10 and adapter 20 according to the first preferred embodiment of the present invention along with oil drain valve 30 of a known design. Valve 11 is shown in an open position. Directional arrows are shown to indicate the oil flow through the combined elements 10, 20, and 30. For illustrative purposes, hose 15 and connector 10 are shown partially cut away. This provides a clear view of hose 15, which is preferably stretch-fit over annular ribs 18 on the connector base 10*b* during normal operation of the invention.

Figure 7:
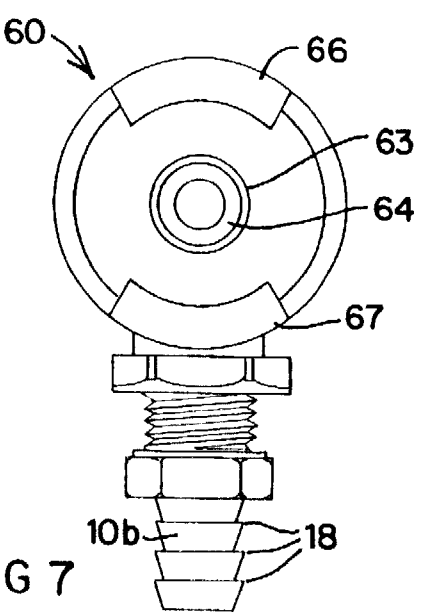
FIG. 7 is a connection-side view of the connector as shown in FIG. 6 in accordance with the second preferred embodiment of the present invention.
Figure 6:
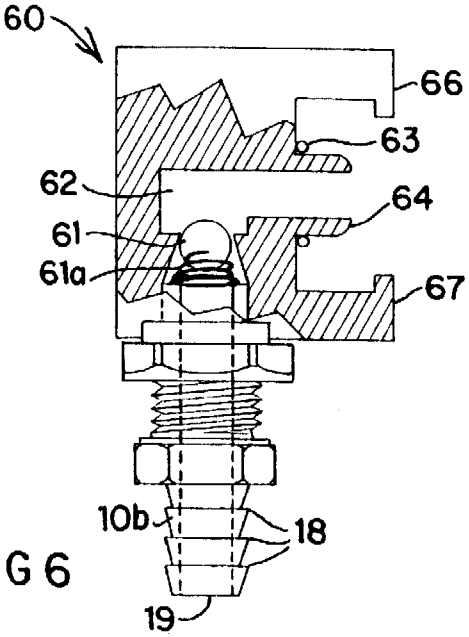
FIG. 6 is a partially cut-away side view of a connector in accordance with a second preferred embodiment of the present invention, showing a ball-and-spring valve blocking the oil-flow path.

FIGS. 6 and 7 illustrate a second preferred embodiment of the present invention, differing from the first preferred embodiment by the shape of the connector head. Connector head 60 is of a circular design. As well, alternate designs of both head and base may be made without straying from the scope of the present invention. Accordingly, the operation of the second preferred embodiment does not differ from that described above with reference to the first preferred embodiment. Connector base 10*b* is the same in both preferred embodiments and includes annular retaining rings 18 and lower oil passageway 19. Upper passageway 62 provides a path for oil in connector head 60 to flow from raised inlet 64 past ball valve 61 and spring 61*a* to lower oil passageway 19. Adapter 20 (not shown) attaches to connector head 60 by way of flanges 66 and 67 and is sealed by O-ring 63.

Figure 8:
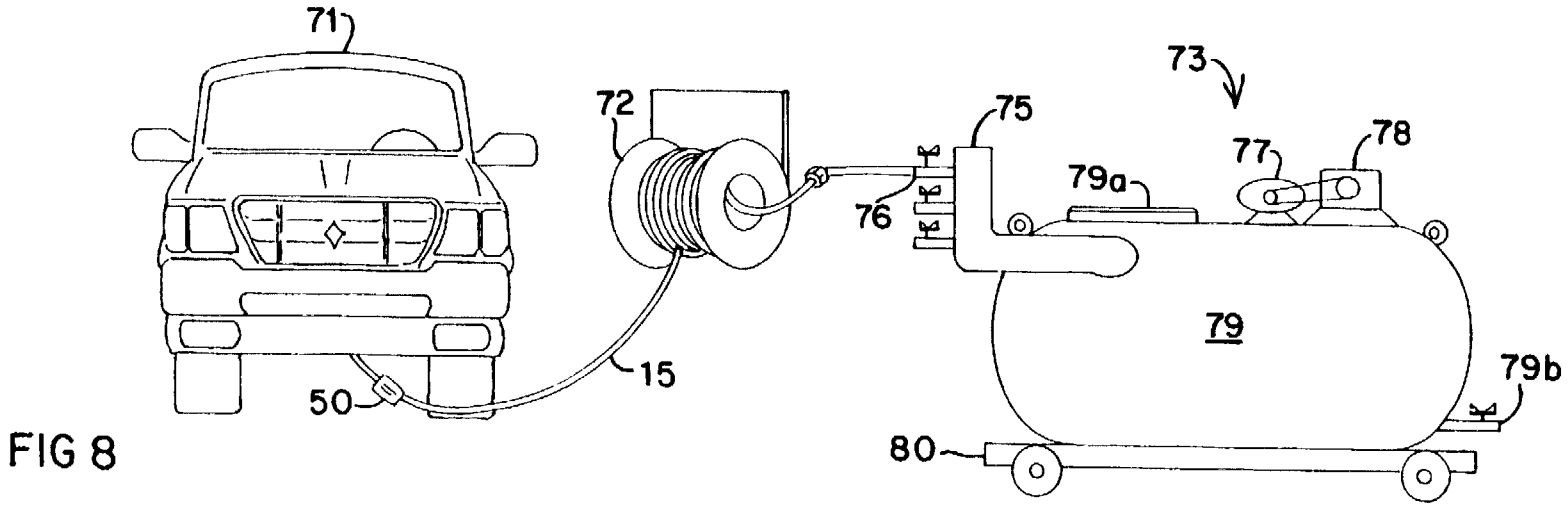
FIG. 8 is a schematic diagram an oil vacuum retrieval system using the adapter/connector/common oil drain valve combination as shown in FIG. 5.

With reference to FIGS. 5 and 8, it can be seen that the quick-connect hookup 50 creates a secure connection between an oil reservoir of a vehicle 71 and an oil evacuation system that includes a hose reel 72 and a portable pumping unit 73. When connector 10 is not in use, the threaded section 22 of adapter 20 is screwed into oil drain valve 30 in a substantially permanent manner. Assembly or disassembly of the quick-connect hookup 50 is accomplished by rotating the connector 10 by 90 degrees in either a clockwise or a counter-clockwise direction. When assembled together, quick-connect hookup 50 is held securely in place with tabs 21*a* and 21*b* contained within recesses 16*a* and 17*a*. Leakage and contamination of waste oil is prevented by sealing adapter 20 to connector 10 by way of O-ring 13. It should be understood that the adapter 20 may be given different shapes and sizes without straying from the scope of the present invention. The critical aspect of adapter 20 is that it be able to provide easy attachment of connector 10 to assorted oil-drain-valves.

Therefore, various shapes and sizes of the threaded section 22 may be formed to fit a variety of oil drain valve openings. However, standardization of tabs 21*a* and 21*b* is maintained so that connector 10 may be used with an assortment of oil drain valves.

With further reference to FIGS. 5 and 8, a method according to the present invention will be set out. The method of evacuating oil from an oil-carrying machine, shown as vehicle 71, utilizes the quick-connect hookup 50. The method involves the step of incorporating adapter 20 into oil drain valve 30. The combined adapter 20 and oil drain valve 30 are then fitted into the oil-drain-plug-hole (not shown) commonly found in the engine compartment of a motor vehicle such as vehicle 71. The method further includes the step of attaching connector 10 (with valve 11 closed) to adapter 20 with a smooth twisting and slight pushing motion until tabs 21*a* and 21*b* are securely seated in recesses 16*a* and 17*a*. This creates a positive connection sealed by O-ring 13 to prevent leakage of waste oil.

After assembly of the quick-connect hookup 50, oil evacuation is accomplished by the following additional steps. A motor 77 is switched ON to power vacuum pump 78 so that storage tank 79 is depressurized. The tank 79 is preferably air tight and begins at atmospheric pressure (14.7 psia). The vacuum pump 78 pumps air out of tank 79 to bring tank 79 below atmospheric pressure. Once a suitable reduced pressure is established in the tank 79 (e.g., –7 psig), the oil drain valve 30 and the sliding connector valve 11 are opened. The waste oil, which is at atmospheric pressure, is drawn into tank 79 through hose 15 (which may be kept on a retractable wall-mounted hose reel 72), and through tank inlet valve 76 located at valve-bank 75.

Removing waste oil from tank 79 is accomplished by closing tank inlet valve 76, reversing vacuum pump 78 and pumping air into the tank, thus pressuring it to above atmospheric pressure, and opening tank outlet valve 79*b*.

The inside of tank 79 may be accessed for cleaning or removing sediment through tank portal 79*a*. Further, the tank 79 may be a portable unit 73 that is mounted on a wheeled platform 80 to facilitate movement.

It should be understood that the preferred embodiments mentioned above are merely illustrative of the present invention. Numerous variations may be contemplated in view of the following claims without straying from the intended scope and field of the invention herein disclosed.

I claim:

1. A quick-connect hookup adapted to be used with an oil drain valve, said quick-connect hookup comprising:

a) an adapter having a first standardized section and a customized section, said first standardized section including at least one tab and said customized section being separate from and adapted to be attachable to an outlet of an oil drain valve wherein said customized section includes circumferential threads adapted to permit the outlet of the oil drain valve to be threadingly attached to said customized section, and wherein said customized section includes an annular rina located therein, wherein said annular ring is capable of supporting a ball valve of said oil drain valve; and b) a connector having a second standardized section wherein said second standardized section includes a flange located on a side of said connector inlet and opposingly arranged with a connector recess therebeneath; and wherein said first standardized section and said second standardized section are connectable to one another via said at least one tab so as to allow oil to pass from the oil drain valve serially through said adapter and said connector, and wherein said adapter includes an aperture centrally located therein, said connector includes an inlet opening and an outlet opening with an oil passageway, located therebetween, wherein a valve means is located within said oil passageway, wherein an O-ring seal is located between said adapter aperture and said connector inlet, wherein said at least one tab of said adapter is sized to substantially conform to said connector recess and thereby connect said connector to said adapter with said O-ring compressed therebetween.

2. The quick-connect hookup as claimed in claim 1 further comprising:

a) a plurality of retaining rings located on a base portion of said connector; and b) a hose attachable to said base portion and held firmly by said retaining rings.

3. The quick-connect hook-up as claimed in claim 2 wherein said first standardized section of said adapter includes two tabs and said connector includes two connector recesses for connecting said two tabs of said adapter to said connector.

4. A quick-connect hookup providing oil flow therein for use with an oil pan-mounted oil drain valve, said quick-connect hookup comprising:

a) an adapter having an aperture centrally located therein and including a first standardized section with two tabs oppositely arranged thereupon and a customized threaded section attachable to an outlet of an oil drain valve;

b) a connector having an inlet opening and an outlet opening with an oil passageway located therebetween including a second standardized section and having two flanges located at either side of said connector inlet and opposingly arranged with recesses therebeneath;

c) a valve means located within said oil passageway;

d) an O-ring seal located between said adapter aperture and said connector inlet; and wherein each of said adapter tabs is sized to substantially conform to one of said connector recesses and thereby connect said connector to said adapter with said O-ring compressed therebetween, and wherein said customized section of said adapter includes an annular ring located therein and adapted to support a ball valve of the oil drain valve.

5. The quick-connect hookup as claimed in claim 4 further comprising:

a) a plurality of retaining rings on a base portion of said connector; and b) a hose having one end connected by said retaining rings to said base portion and another end connected to a storage tank.

6. The quick-connect hook-up as claimed in claim 5 wherein said hose is attached to said storage tank at one of a plurality of tank inlet valves.

* * * * *